US005524971A

United States Patent [19]

Jay et al.

[11] Patent Number: 5,524,971

[45] Date of Patent: Jun. 11, 1996

[54] SEATING AND BACK SYSTEMS FOR A WHEELCHAIR

[75] Inventors: Eric C. Jay, Boulder; John C. Dinsmoor, III, Westminister, both of Colo.

[73] Assignee: Jay Medical Ltd., Boulder, Colo.

[21] Appl. No.: 217,366

[22] Filed: Mar. 24, 1994

Related U.S. Application Data

[62] Division of Ser. No. 945,733, Sep. 16, 1992, Pat. No. 5,352,023.

[51] Int. Cl.[6] ..... A47C 7/46

[52] U.S. Cl. ..... 297/383; 297/354.12; 297/440.2

[58] Field of Search ..... 297/230.14, 284.1, 297/353, 354.1, 354.12, 383, 440.2, 452.14

[56] References Cited

U.S. PATENT DOCUMENTS

| | | | |
|---|---|---|---|
| Re. 29,522 | 1/1978 | Barecki | 297/440.2 X |
| D. 335,235 | 5/1993 | Hildreth | D6/601 |
| 1,486,813 | 3/1924 | Tallman | 297/383 X |
| 1,562,658 | 11/1925 | Presley | 297/383 |
| 1,706,794 | 3/1929 | Linebarger et al. | 297/230.14 |
| 4,588,229 | 5/1986 | Jay | 297/459 |
| 4,643,481 | 2/1987 | Saloff | 297/458 |
| 4,660,238 | 4/1987 | Jay | 5/431 |
| 4,726,642 | 2/1988 | Jay | 297/459 |
| 4,728,551 | 3/1988 | Jay | 428/76 |
| 4,761,843 | 8/1988 | Jay | 5/431 |
| 4,842,330 | 6/1989 | Jay | 297/4 |
| 4,951,334 | 8/1990 | Maier | 5/431 |
| 5,018,790 | 5/1991 | Jay | 297/458 |
| 5,062,677 | 11/1991 | Jay et al. | 297/440.2 |
| 5,074,620 | 12/1991 | Jay | 297/444 |
| 5,088,747 | 2/1992 | Morrison | 297/219 |
| 5,110,186 | 5/1992 | Clark et al. | 297/440.2 |
| 5,123,699 | 6/1992 | Warburton | 297/219 |
| 5,189,747 | 3/1993 | Mundy | 5/654 |
| 5,201,780 | 4/1993 | Dinsmoor | 5/455 |
| 5,211,446 | 5/1993 | Jay | 297/353 |
| 5,254,404 | 10/1993 | Dinsmoor | 5/451 |
| 5,297,851 | 3/1994 | Van Hekken | 297/452.14 |

*Primary Examiner*—Peter R. Brown

*Attorney, Agent, or Firm*—Flehr, Hohbach, Test, Albritton & Herbert

[57] ABSTRACT

An anti-thrust seating system and low profile, adjustable back system primarily intended for use in a wheelchair. The anti-thrust seating system includes a base seating member with a forward section to support the user's thighs and a rearward section to support the user's buttocks including the ischial tuberosities. The upper surfaces of the forward and rearward sections meet to form an edge extending across the base seating member. The upper surface of the rearward section has two portions which form a first step face or anti-thrust barrier to the user's ischial tuberosities. The seating system further includes at least one separate step means that can be removably positioned adjacent and rearwardly of the first step face wherein the separate step means has a second step face. The separate step means also has an upper surface which serves to effectively extend the thigh supporting surface or shelf rearwardly. The adjustable back system has first and second relatively rigid shell members with a back cushion removably attached to the second or forward shell member. In their retracted positions, portions of both the first and second shell members and cushion extend between and along the back posts of the wheelchair and very little of the back extends forward of the back posts.

15 Claims, 12 Drawing Sheets

Fig. 2
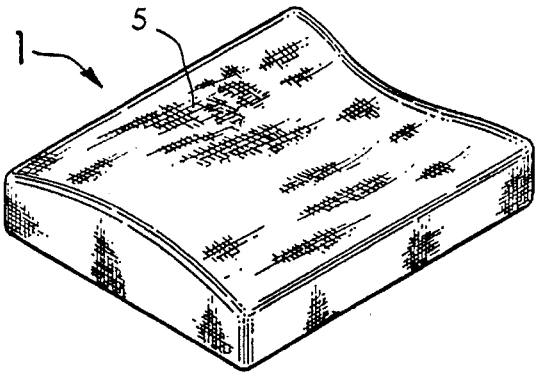
Fig. 3
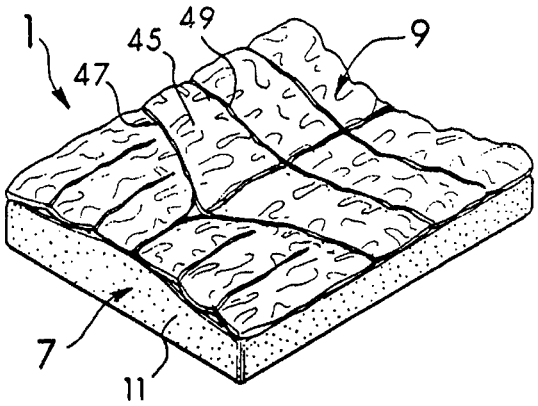
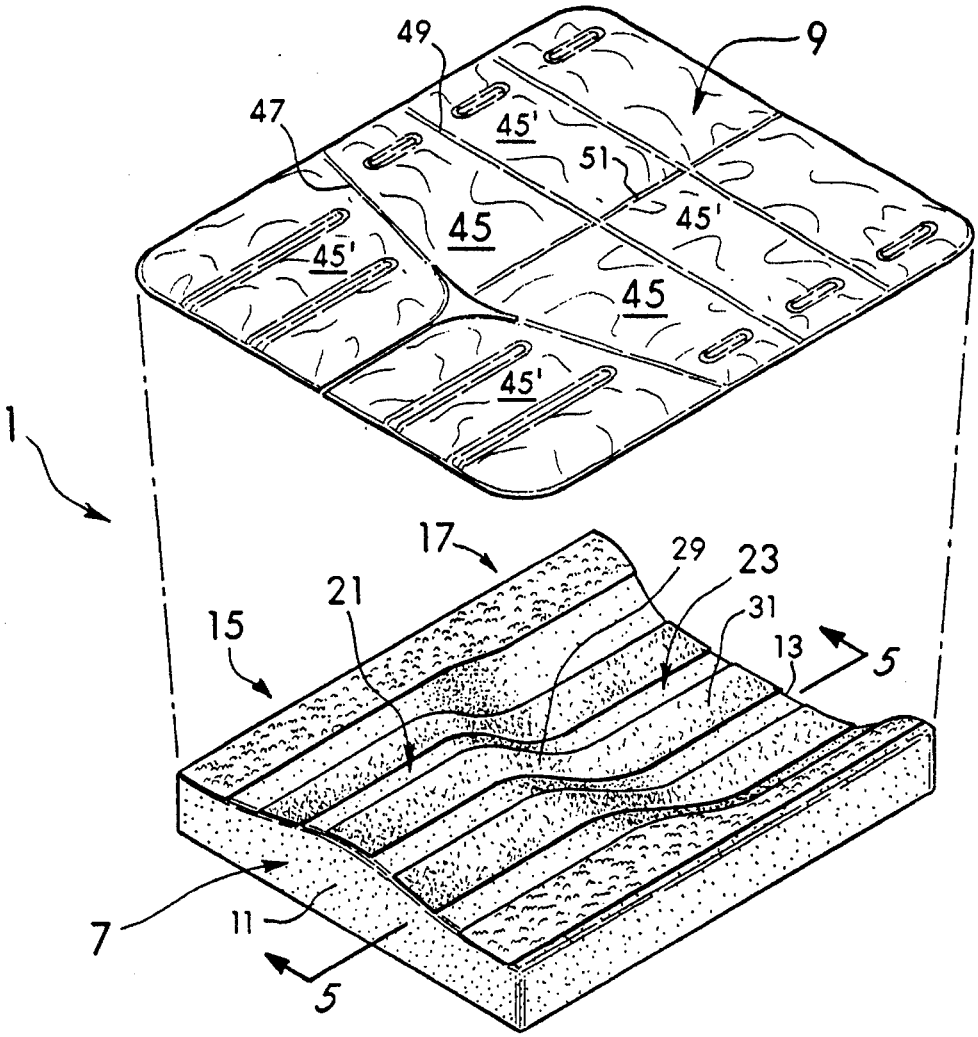
Fig. 4

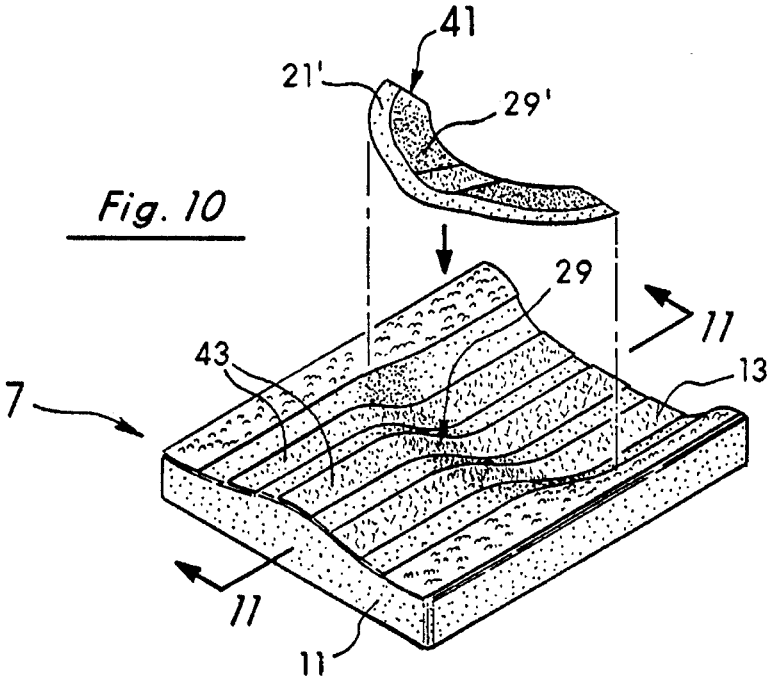
Fig. 10
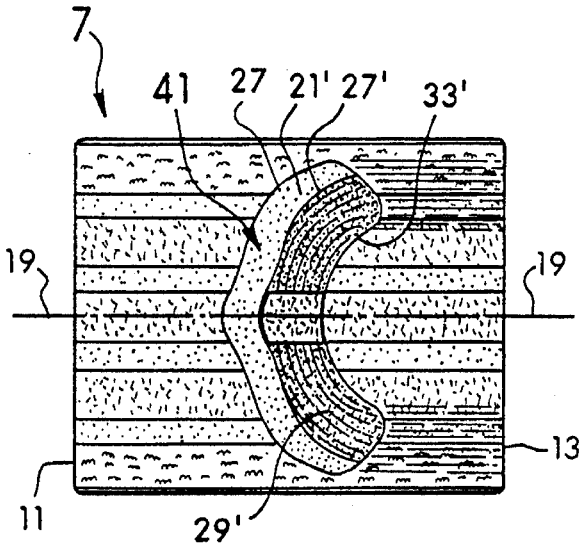
Fig. 12
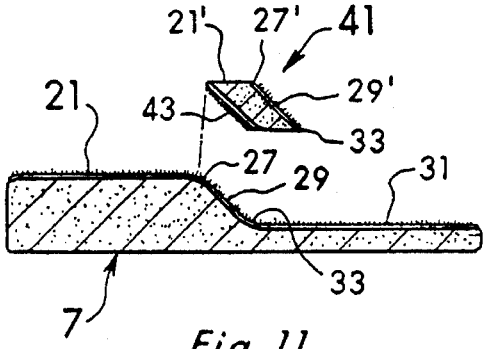
Fig. 11
Fig. 13
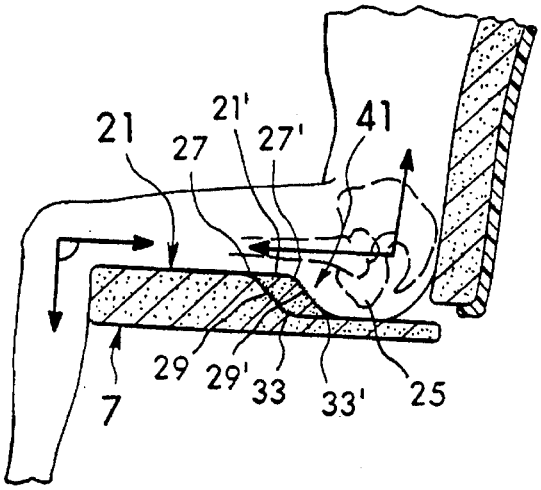

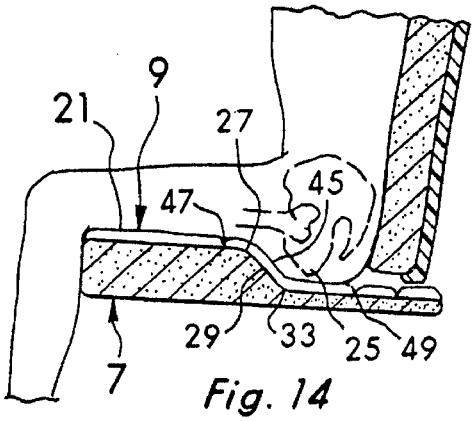
Fig. 14
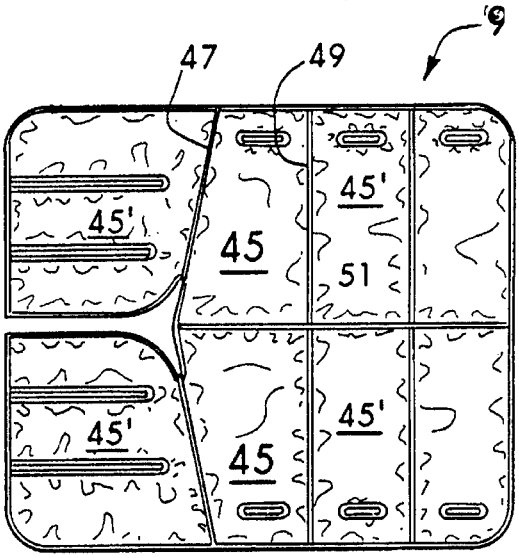
Fig. 15
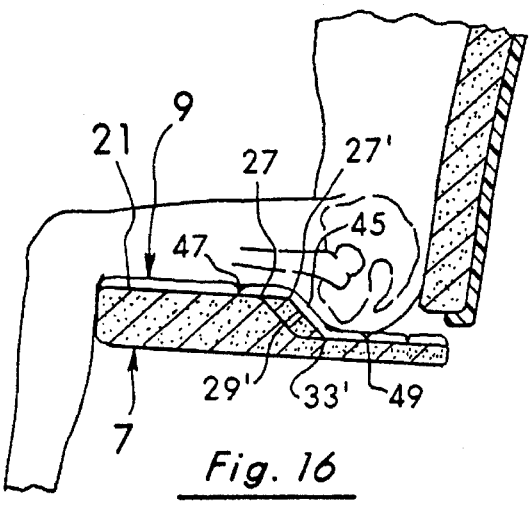
Fig. 16
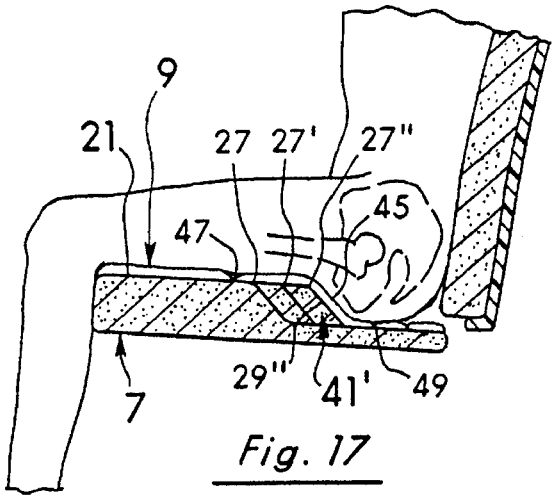
Fig. 17
Fig. 18
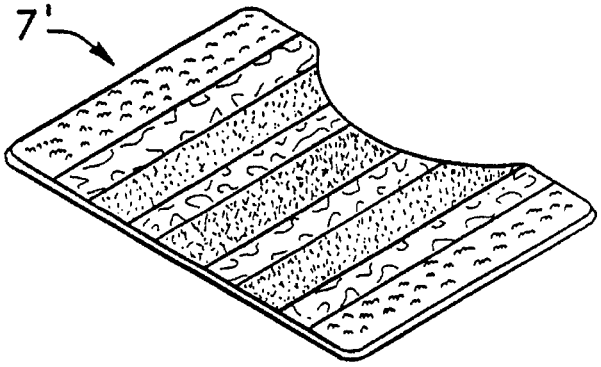
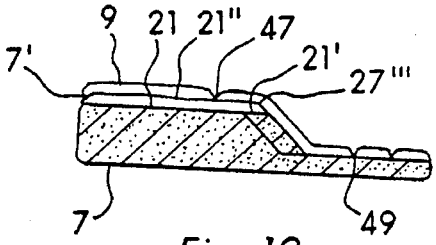
Fig. 19

Fig. 20
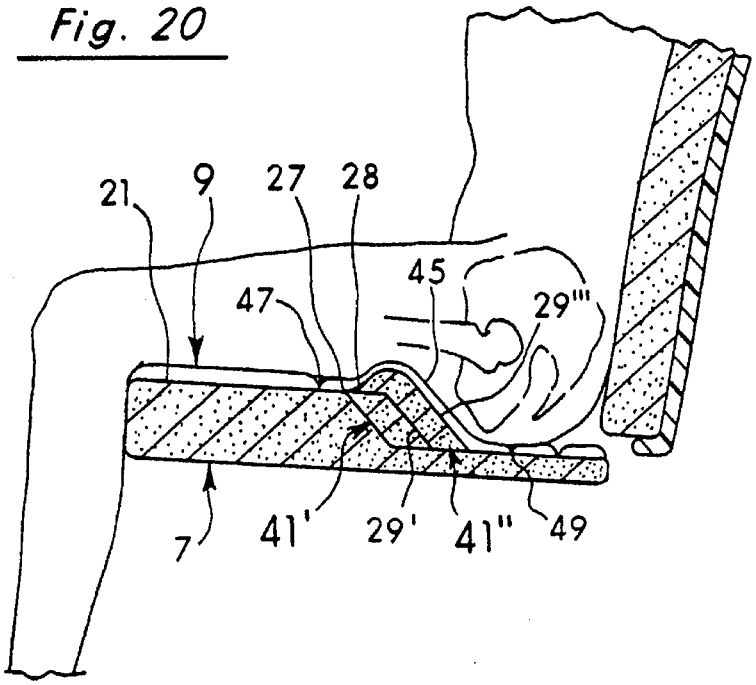
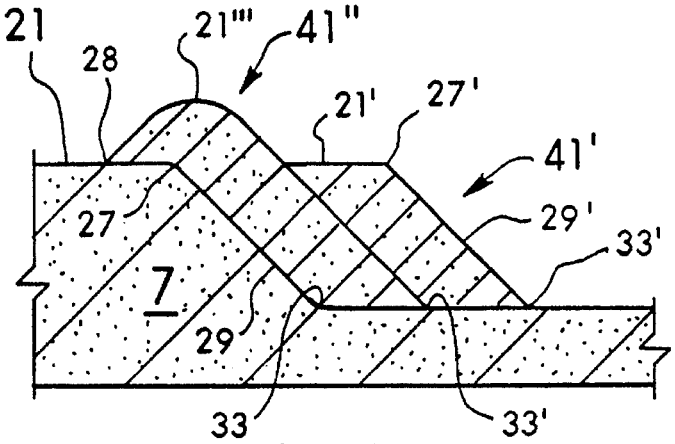
Fig. 21
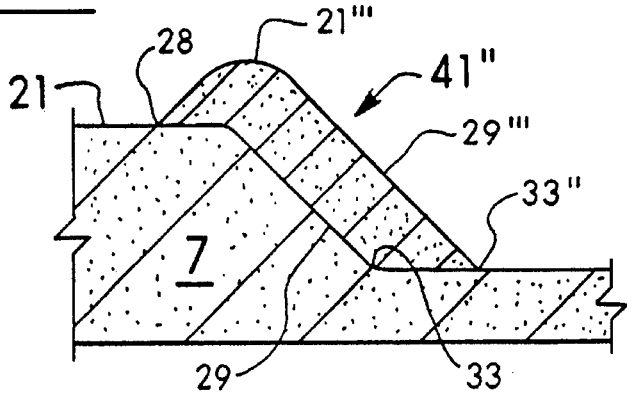
Fig. 22

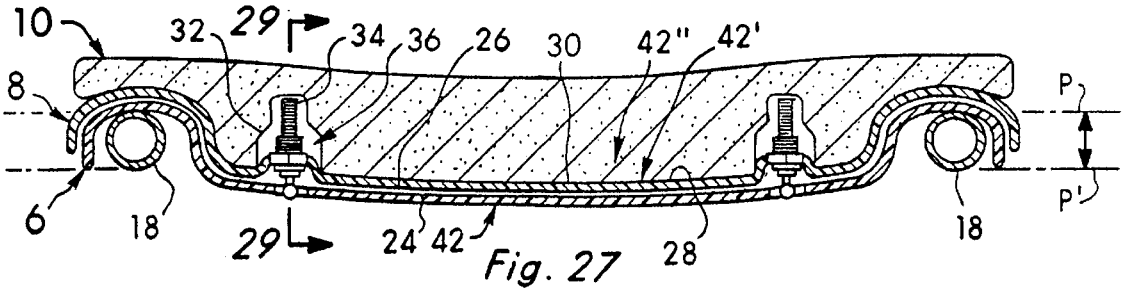
Fig. 27
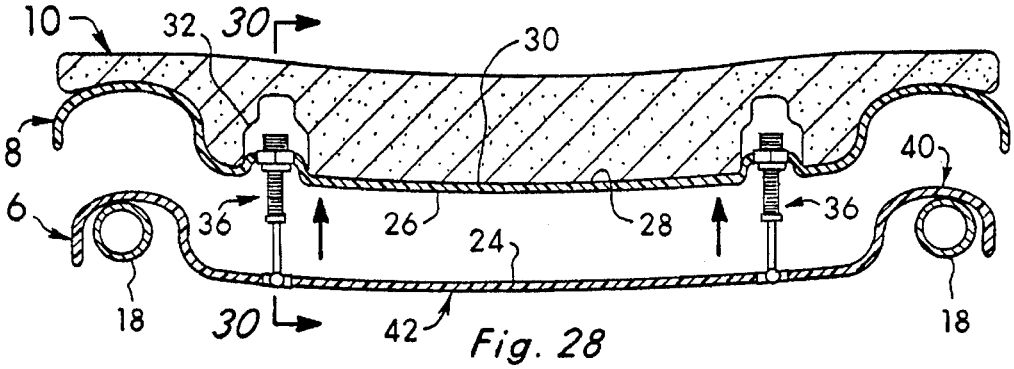
Fig. 28
Fig. 29
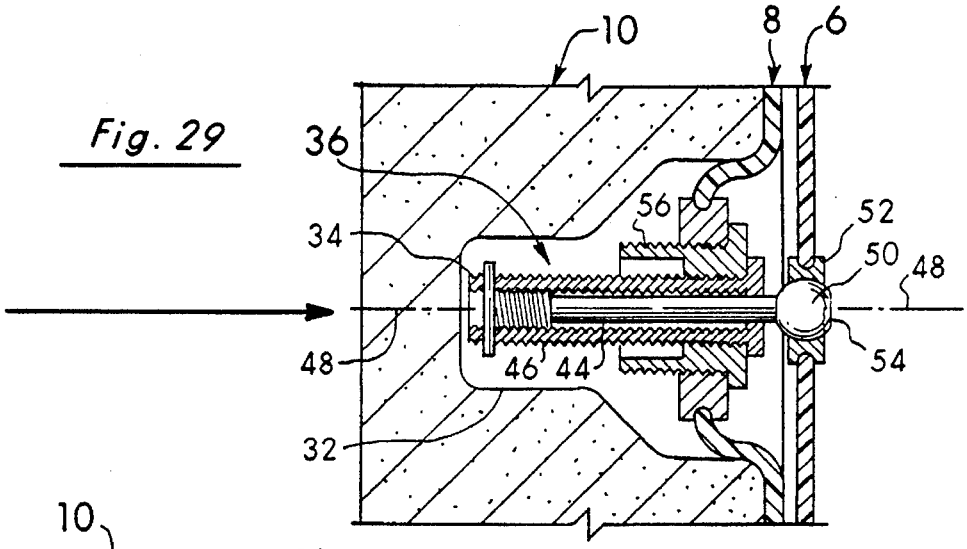
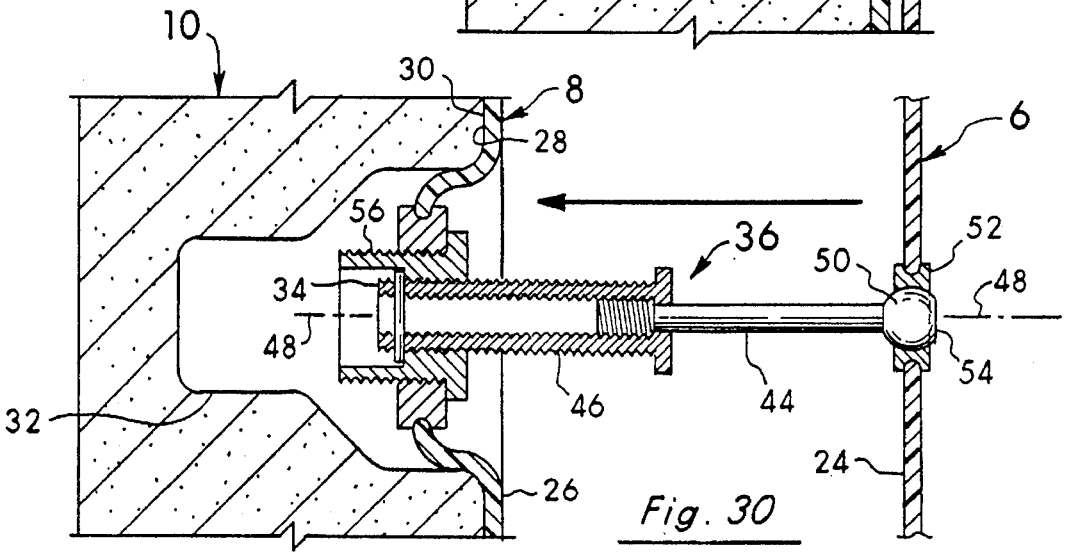
Fig. 30

Fig. 31
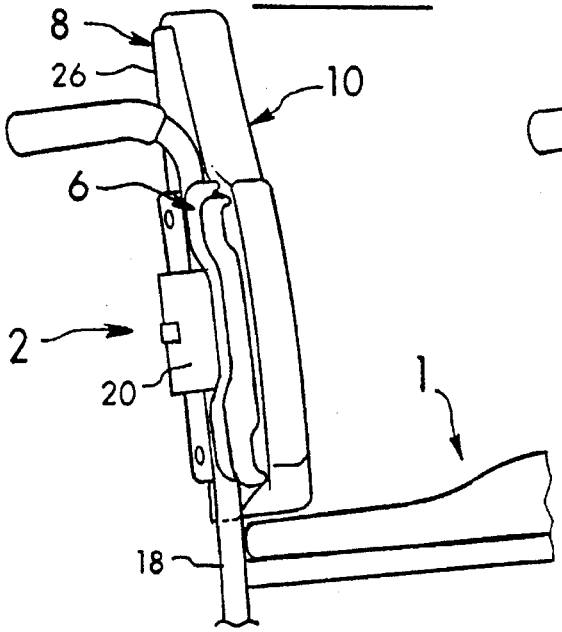
Fig. 32
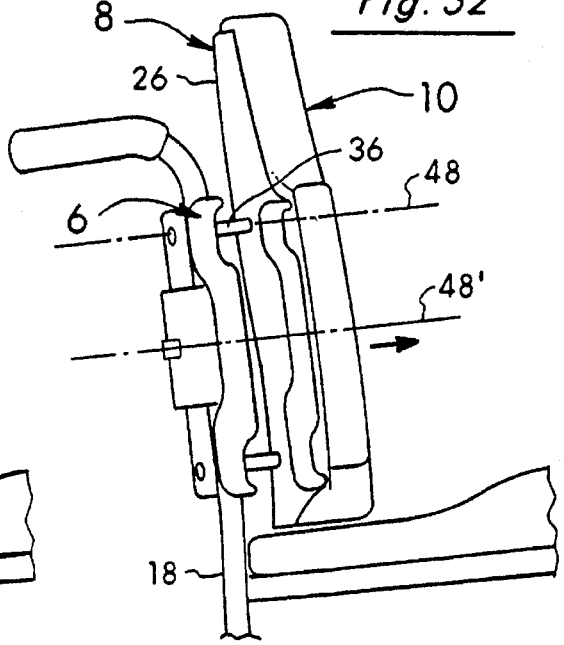
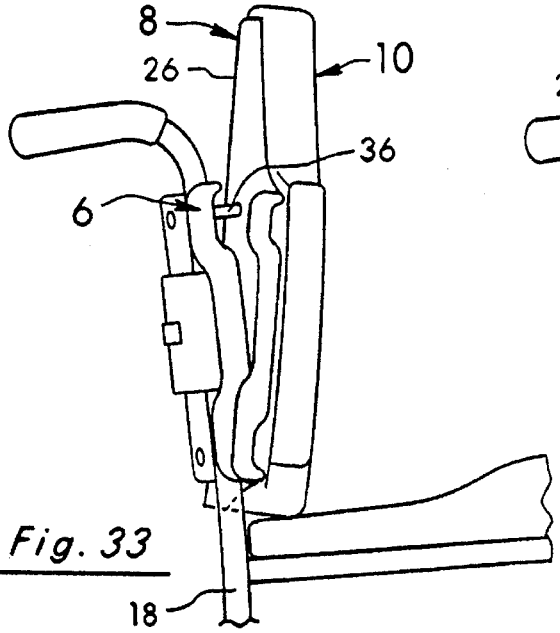
Fig. 33
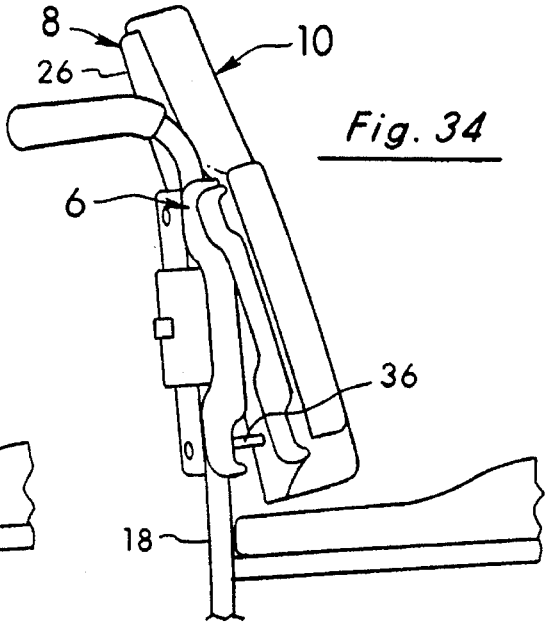
Fig. 34
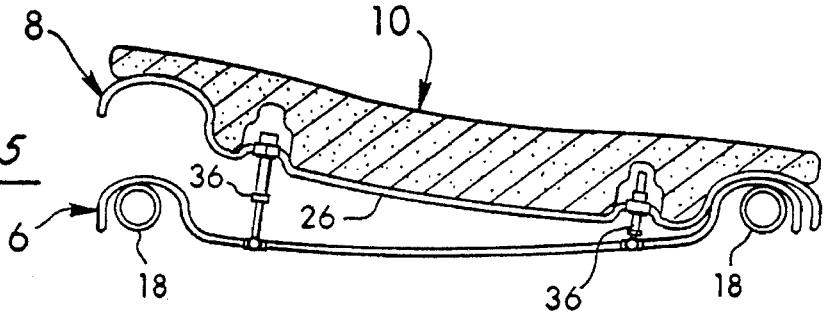
Fig. 35

SEATING AND BACK SYSTEMS FOR A WHEELCHAIR

This is a divisional of application Ser. No 945,733, filed Sep. 16, 1992, now U.S. Pat. No. 5,352,023 issued Oct. 4, 1994.

BACKGROUND OF THE INVENTION

1. Field of the Invention

This invention relates to the field of seating and back systems and more particularly, to the field of seating and back systems for wheelchairs for growing children as well as adults whose bodies are changing as for example, due to weight gain or loss.

2. Discussion of the Background

Growing children present a unique problem to seating and backing systems for wheelchairs in that the fitting requirements of the child are continually changing sometimes even on a month-to-month basis. Consequently, a seating and back system that may properly position and support the growing child one month may not do so the next month or months. Such growth takes place in both the seat and back areas of the child; but, the primary fitting problem is presented in adjusting or modifying the seating portion of the system and in particular, the preischial shelf area.

More specifically, a properly fitting seating system typically has a base seating member or cushion. The base member has a thigh supporting surface or shelf near its front and a step down to a depressed, seating well toward the rear which supports the child's buttocks including his or her ischial tuberosities. The child is preferably positioned with his or her ischial tuberosities (and the flesh immediately forward of them) immediately adjacent the face of the step. Ideally, the back of the child's knees are immediately adjacent the front surface of the seating member in roughly a 90 degree position with the child's feet on the footrests and the child's back is supported roughly in a 95 degree or so position. This aids in achieving maximum support under the thighs to reduce pressure under the ischial tuberosities and in achieving proper leg, pelvic, and spine positioning. However, with time, the child's thigh or femur bones will grow and lengthen often dramatically (e.g., 2 to 3 inches in 2 to 3 years). Although such growth is gradual, it manifests itself in the seating system in a number of ways. In particular, the previously proper fit of the child with the backs of his or her knees against the front of the seating member and his or her ischial tuberosities against the step face now finds the ischial tuberosities spaced rearwardly from the step face due to the femur growth. The end result is that the child often thrusts or scoots his buttocks forward until his or her ischial tuberosities again are immediately adjacent the step face. This can be due to a number of reasons including the fact that a child often lacks the discipline to sit up straight or may have involuntary extensor tone.

Such thrusting or scooting then misaligns the child's knees and legs which can lead to lower extremity deformities including abduction (legs permanently apart), adduction (legs permanently together), windsweeping (both legs permanently off to one side), or subluxation (dislocation) of the femur from the hip joint. Furthermore, such misalignments can lead directly to serious back problems, including permanent deformities, the most common of which is kyphosis or front-to-back curvature of the spine. Other back deformities include lordosis (excessive lumbar curve), and scoliosis (side-to-side curvature of the spine). These problems are further accentuated by the excessive muscle tone frequently found in people with spastic cerebral palsy. If such individuals are not properly positioned in their wheelchairs at every step of their growth process, the development of permanent deformity is frequent.

In the past, such fitting needs of a growing child were simply met by replacing the entire seating member with a larger one every 6 to 12 months. Such a process is obviously expensive. Further, in making such replacements in 6 to 12 month stages, the immediate fitting needs of the child at each stage were often not even met as the tendency was to compromise at each stage and to provide a larger than needed seating cushion in order to allow for some growth. Toward the end of any such stage, the fitting needs of the growing child were also usually not met as the tendency was to wait until the child had clearly overgrown the seating system before replacing it. In the meantime, seat belts, shoulder harnesses, and other restraints were often needed to maintain the child in the seating system not to mention the continuing discomfort and potential damage of such an ill-fitting seating system.

Another approach has been to use "linear" seating systems, consisting of plywood padded with foam. With these systems, the changing contours of the body did not significantly affect the fit of the seating, as substantial body contact was never achieved. Body contoured seating has been successfully developed for adults in wheelchairs (see, for example, applicant's U.S. Pat. Nos. 4,588,229, 4,726,624; and 5,018,790). These contoured systems have provided increased body contact, with a resulting increase in stability and positioning capability. This additional stability and contact have also been extremely effective in reducing the spasticity and tone that has pulled the child's bones into deformity. Such generic contours, particularly in a cushion, have been recognized to be of great value to children, but have been in limited use because as the child grew, the child invariably began sitting on the anti-thrusting shelf built into the contoured cushion. As a result, contoured seating has been used only minimally with children, with the effect that the individuals who most needed positioning were the ones least likely to receive it. In this regard, the reason children need positioning more than adults is that their bones are soft and are very susceptible to being pulled into permanent deformities, particularly during growth spurts.

With the above in mind, the seating and back systems of the present invention were developed. With them, a preischial shelf extender or separate step means is provided wherein the seating cushion in the area of the ischial tuberosities can be selectively and progressively modified to accommodate the changing needs of the growing child. The basic, overall seating system of the present invention can then be used for a number of years in contrast to current seating systems that often need full replacements every few months. Additionally, the needs of a fully grown adult can also be met with the seating system of the present invention wherein an off-the-shelf or standard sized seating member can be easily and quickly modified and customized to specifically fit the adult. Adults whose bodies are changing (e.g., by weight gain or loss) or whose diagnoses are changing can also be accommodated. Other modifications and additions have also been made in the seating system of the present invention including a specially designed fluid pad. An adjustable back system was also specially developed for use with the seating system of the present invention; however, it can be used with other seating systems if desired. The adjustable back system permits the position of the back to be varied about multiple axes to meet the special needs of the child or adult user. The adjustable back system further includes unique features that provide a very desirable, low profile yet permit significant modes of adjustment.

SUMMARY OF THE INVENTION

This invention involves an anti-thrust seating system and low profile, adjustable back system primarily intended for use in a wheelchair.

The anti-thrust seating system includes a base seating member with forward and rearward sections. The forward section has an upper surface to receive and support the user's thighs and the rearward section has a depressed, seating well to receive and support the user's buttocks including the user's ischial tuberosities. The upper surfaces of the forward and rearward sections meet to form an edge extending across the base seating member. The upper surface of the rearward section has two portions with the first portion extending downwardly and rearwardly of the edge to form a first step face or anti-thrust barrier to the user's ischial tuberosities. The seating system further includes at least one separate step means that can be removably positioned adjacent and rearwardly of the first step face wherein the separate step means has a second step face.

In use, the separate step means with its second step face serves to effectively extend the first step face rearwardly. For example, if the first step face is too far forward and does not properly position the user, the separate step means can then be added to properly fit and support the user's ischial tuberosities positioned near or immediately adjacent the second step face. This is true whether the user being fitted is a growing child or fully grown adult. The separate step means also has an upper surface and in use, the upper surface aligns with the upper surface of the forward thigh supporting section of the base seating member. In doing so, it serves to effectively extend the thigh supporting surface or shelf rearwardly. In this manner, the separate step means forms a pre-ischial shelf extender to better fit the user and in particular, a growing child whose seating requirements are constantly changing. In one embodiment, this shelf extender is taller or higher than the shelf of the forward section. This produces a fulcrum which can be very effective in reducing ischial pressure during sitting as the weight of the legs actually leverages the person's weight off the ischial tuberosities.

The base seating member and pre-ischial shelf extender can be used with or without a covering fluid pad. However, if it is used with a fluid pad, the pad is preferably designed and dimensioned so as to avoid having any lateral seams in the step area. The seating system also includes an extra or separate base member or cushion. The separate cushion can be positioned both above the upper surface of the forward section of the base seating member and the upper surface of the separate step member to further raise the thigh supporting surfaces in relation to the footrests and seating well area under the ischial tuberosities. This provides more resistance to the user's thrusting and reduces pressures on the ischial tuberosities and coccyx. In other embodiments, the separate cushion can be used with the base seating member without the pre-ischial shelf extender and with or without the fluid pad.

The adjustable back system of the present invention is designed to be used with the seating system but can be used separately if desired. The back system has first and second relatively rigid shell members with a back cushion removably attached to the second or forward shell member. The first or rearward shell member is removably attached to the back posts of the wheelchair and has a first portion that extends substantially between and along the posts. The forward shell member is then mounted to the first portion of the rearward shell member and can be moved relative to it and the back posts to a number of positions to properly fit and support the user.

The first and second shell members of the back system nest in their retracted position to present a desirable, low profile. In this retracted position, portions of both the first and second shell members extend between and along the back posts of the wheelchair and very little of the back extends forward of the back posts. Additionally, the cushion nests with the forward shell member to further minimize the back's profile. The means for moving the shells relative to each other in the preferred embodiment includes a plurality of screw arrangements. Each screw arrangement has a front end portion that projects through the front shell member and into specially provided depressions in the back surface of the cushion. In this manner, the projecting end portions of the screw arrangements when the shells are fully retracted are received in the cushion depressions to further minimize the overall profile depth of the back system. In use, the back system can be selectively operated to place the forward shell member and the cushion in a variety of positions about multiple axes to meet the positioning needs of the child or adult user. The adjustable back also enables the user to place the seating cushion in a typical position (i.e., wherein the cushion does not protrude rearwardly beyond the back posts on the wheelchair) rather than having to move the cushion too far rearwardly for a proper fit. This is particularly advantageous since most wheelchair footrests and frame depths are essentially non-adjustable and to a certain extent dictate where the seating cushion must be positioned on the wheelchair for a proper fit.

BRIEF DESCRIPTION OF THE DRAWINGS

FIG. 2 is a view of the anti-thrust seating system of the present invention removed from the wheelchair.

FIG. 3 is a view of the anti-thrust seating system of FIG. 2 with the cover removed to show the base seating member and the fluid pad positioned on it.

FIG. 4 is an exploded view of the base seating member and fluid pad.

FIG. 10 illustrates a pre-ischial shelf extender or separate step means according to the present invention.

FIG. 11 is a view taken along line 11—11 of FIG. 10.

FIG. 12 is a top plan view of the pre-ischial shelf extender or separate step means of the present invention in place on the base seating member, FIG. 13 is a view similar to FIGS. 8 and 9 showing the pre-ischial shelf extender or separate step means in place to properly position and fit the person of FIGS. 8 and 9 in the seating system, FIG. 14 is a view similar to FIG. 7 showing a fluid pad on the base seating member.

FIG. 15 is a top plan view of the fluid pad,

FIG. 16 is a cross-sectional view similar to FIG. 13 showing the fluid pad positioned over the base seating member and pre-ischial shelf extender or separate step means.

FIG. 17 is a view similar to FIG. 16 showing the use of two, pre-ischial shelf extenders.

FIG. 18 is a perspective view of an additional thigh supporting member or cushion.

FIG. 19 illustrates the additional thigh supporting member in use with a pre-ischial shelf extender or separate step means of the present invention and a fluid pad.

FIG. 20 is a view similar to FIG. 17 but showing the use of a modified pre-ischial shelf extender that includes a raised bump portion.

FIG. 21 is a view similar to FIG. 20 showing the versatility of placing the shelf extender with the raised bump portion ahead of a shelf extender with a relatively flat top to position the bump as desired.

FIG. 22 is a view similar to FIGS. 20 and 21 showing the use of a single shelf extender with a raised bump portion.

FIG. 27 is a simplified view taken along line 27—27 of FIG. 26 showing the relatively rigid shell members of the back system in their low profile, retracted position.

FIG. 28 is a view similar to FIG. 27 showing the shell members in an extended position.

FIG. 29 is a view taken along line 29—29 of FIG. 27 showing one of the screw arrangements for moving the shell members in its retracted position.

FIG. 30 is a view taken along line 30—30 of FIG. 28 showing the screw arrangement of FIG. 29 in its extended position.

FIGS. 31–35 show various positions to which the front shell member and cushion can be adjusted to meet the needs of the user.

DETAILED DESCRIPTION OF THE PREFERRED EMBODIMENTS

Figure 1:
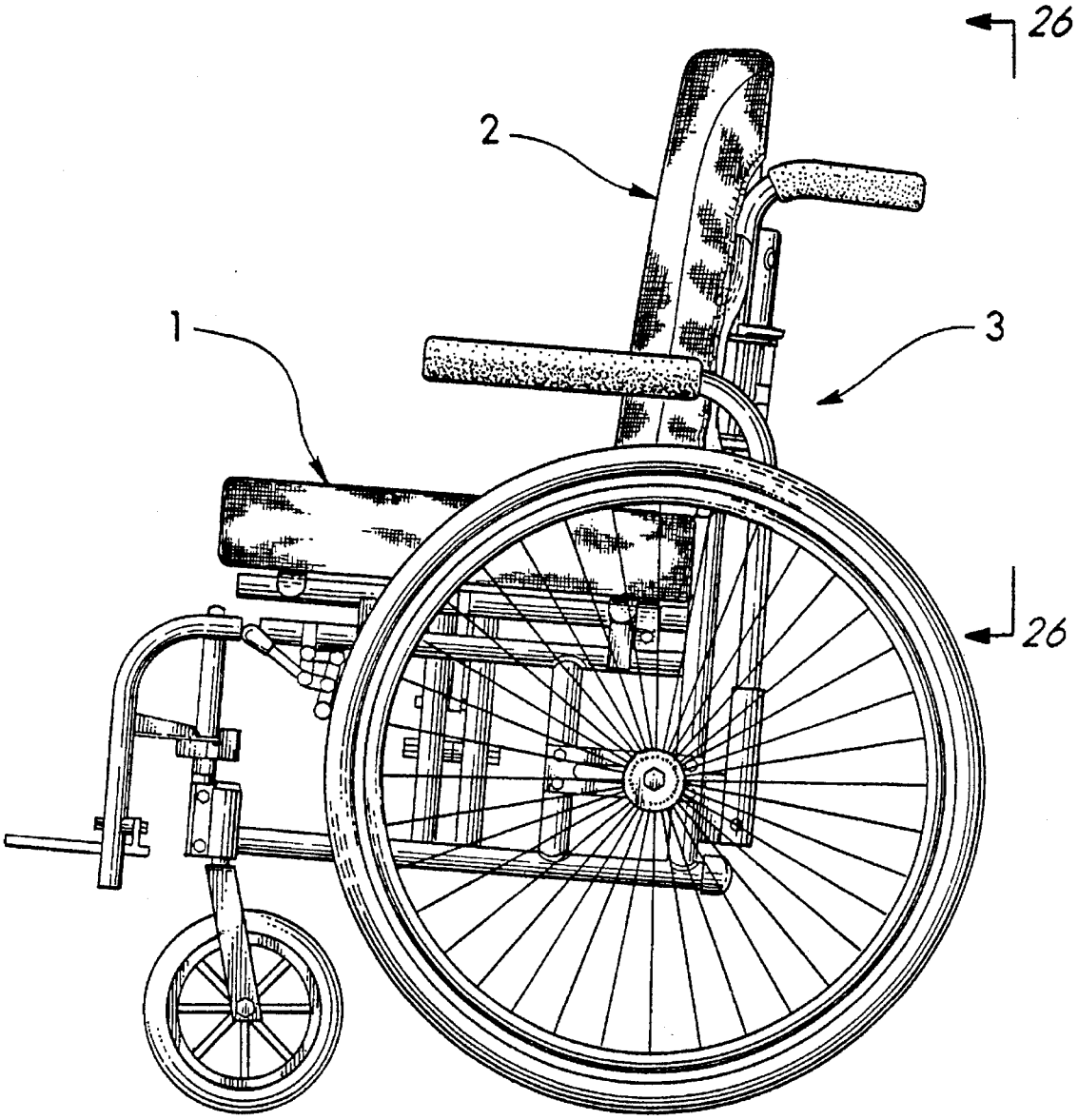
FIG. 1 is a side elevational view of a wheelchair with the anti-thrust seating system and the adjustable back system of the present invention.

As illustrated in FIG. 1, the anti-thrust seating system 1 and adjustable back system 2 of the present invention are primarily intended to be used in a wheelchair 3. In this preferred arrangement, the seating and back systems are used together to properly position and support the user; however, they can be used separately if desired. They can also be used in other conveyance means such as a baby stroller.

Seating System

The seating system 1 as best seen in FIGS. 2–4 includes an outer cover 5 (see FIG. 2) positioned over a base seating member 7 (see FIG. 3) and fluid pad 9. The base seating member 7 is preferably a foam cushion but can be a relatively rigid tray. It can also be used in the present invention with or without the fluid pad 9 and even independently of the wheelchair 3.

Figure 5:
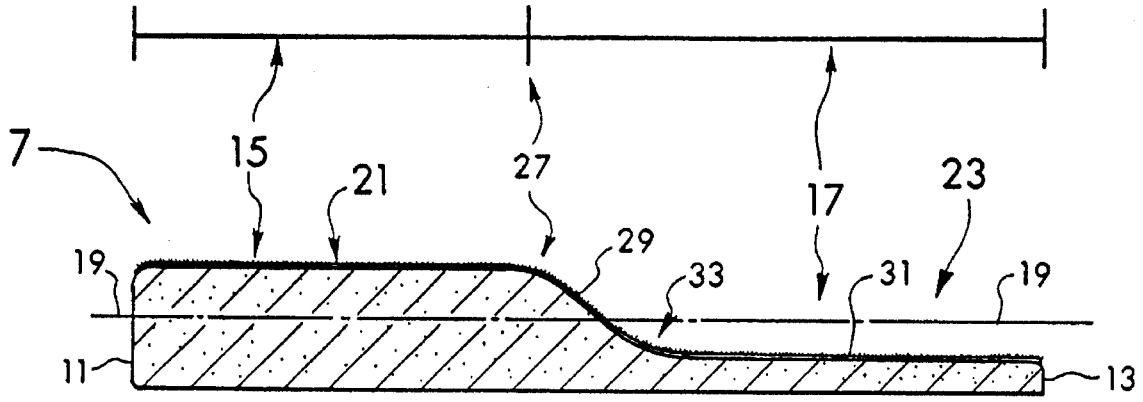
FIG. 5 is a cross-sectioned view taken along lines 5—5 of FIGS. 4 and 6.
Figure 6:
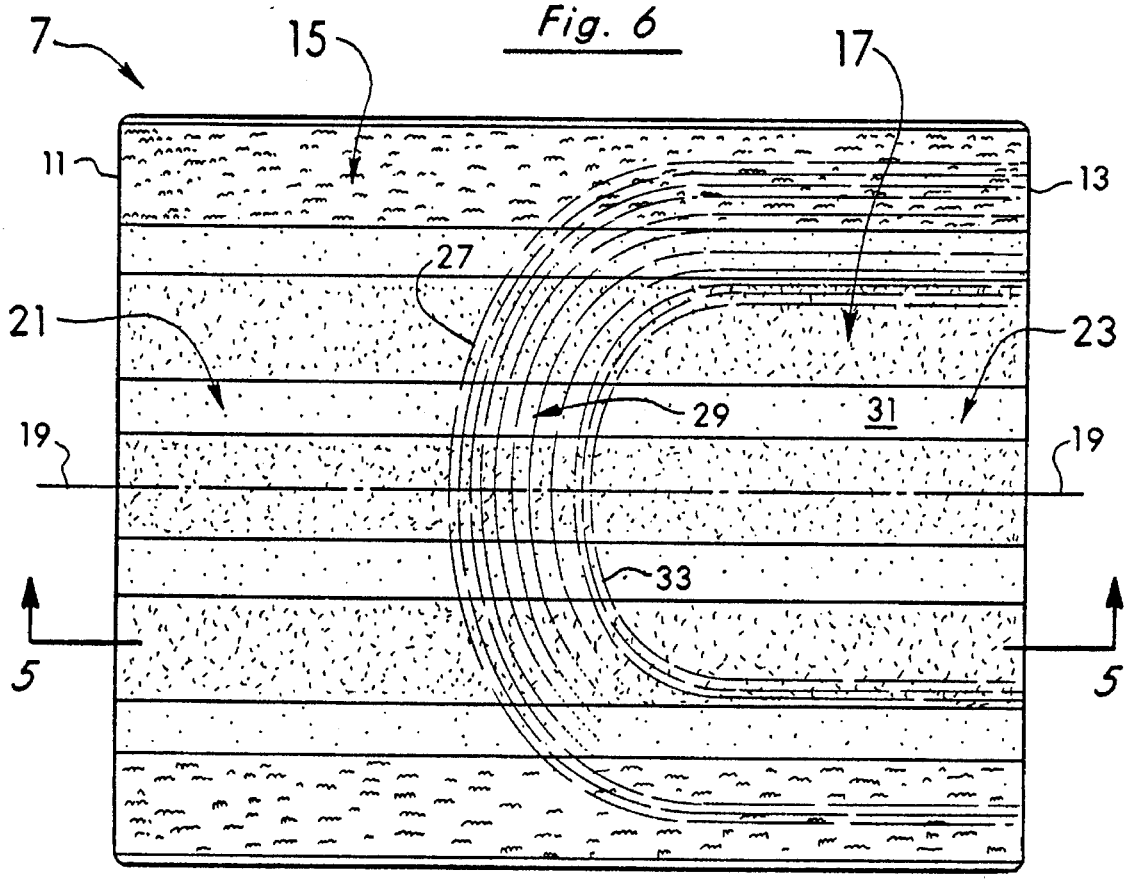
FIG. 6 is a top plan view of the base seating member of FIG. 5.

The base seating member 7 as shown in FIGS. 5 and 6 has front and rear surfaces 11 and 13. The base seating member 7 is then essentially divided into forward and rearward sections 15 and 17 which extend adjacent one another substantially from the front surface 11 to the rear surface 13 along the central axis 19. The forward section 15 has an upper surface 21 which forms a shelf to receive and support the user's thighs (see FIG. 7). This surface 21 as best seen in FIG. 6 extends substantially along and across the central axis 19. The rearward section 17, in turn, has an upper surface 23 forming a depressed, seating well to receive and support the user's buttocks including his or her ischial tuberosities 25 (see again FIG. 7). The upper surface 21 is typically at an elevation above the upper surface 23 to produce increased support under the user's thighs and thus reduce that portion of the user's weight supported by the buttocks. The skin and tissue interface pressures are thereby reduced at the sensitive bony prominences on the buttocks (i.e., ischial tuberosities, coccyx, and trochanters) and redistributed to underneath the thighs which generally can sustain higher tissue interface pressures.

The upper surfaces 21 and 23 of the forward and rearward sections 15 and 17 (see FIGS. 5 and 6) meet to form an upper edge 27. The upper edge 27 extends substantially across the central axis 19 on each side of the base seating member 7. The upper surface or seating well 23 of the rearward section 17 has two portions 29 and 31. The first portion 29 as best seen in FIG. 5 extends or slopes downwardly and rearwardly at about 45 degrees from the upper edge 27. As shown, this is in an area immediately adjacent and rearward of the edge 27 wherein the first portion 29 serves to form a step face. The second portion 31 of the seating well 23 extends rearwardly of the first portion 29 from the lower edge 33 that is formed by the meeting of the first and second portions 29 and 31 of the rearward surface 23.

Figure 7:
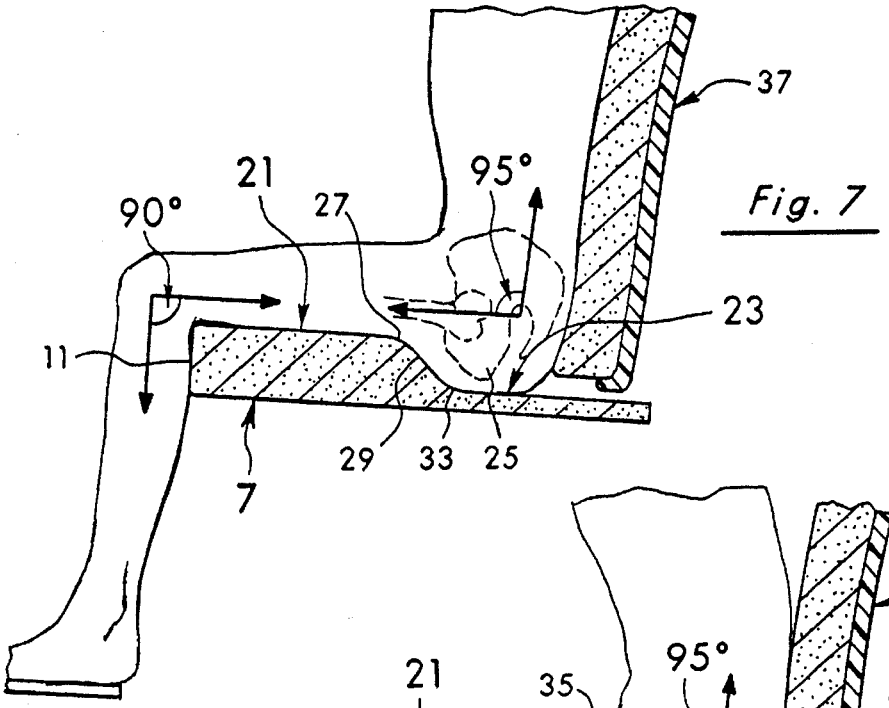
FIG. 7 is a cross-sectioned view showing a person properly positioned and fitted in a seating system.
Figure 8:
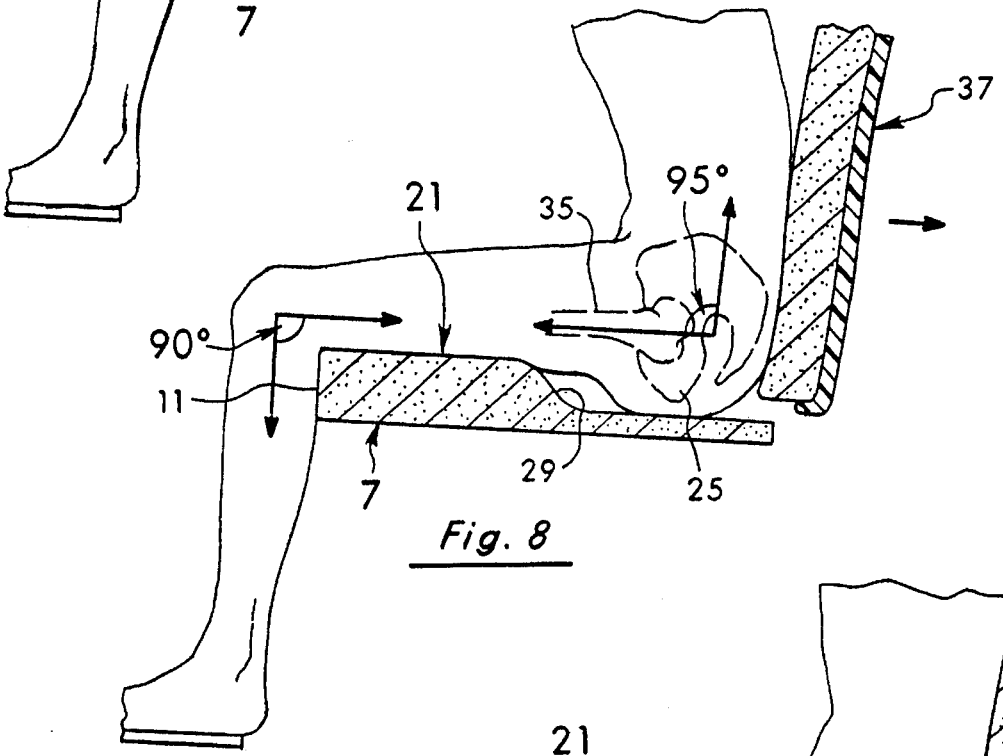
FIG. 8 is a view similar to FIG. 7 showing a person either who has grown from the size of FIG. 7 or who is otherwise improperly positioned and fitted in a seating system.

In a proper fitting as shown in FIG. 7, the step face 29 and surface 21 under the user's thighs form a shelf-step arrangement. This arrangement is positioned in front of the user's ischial tuberosities 25 wherein the step face 29 serves as a barrier (e.g., 1–4 inches high) to prevent undesirable forward thrust or movement of the user's ischial tuberosities 25. That is and referring to FIG. 8, if the user is a growing child for example, his or her thigh or femur bones 35 will grow significantly from the position of FIG. 7 to the position of FIG. 8. In doing so, the growing child unintentionally and undesirably alters and actually destroys the proper fit of FIG. 7. In the proper fit position of FIG. 7, the backs of the child's knees are adjacent and preferably touching the front surface 11 of the base seating member 7. His or her ischial tuberosities 25 are then positioned near or immediately adjacent the step face 29 of the pre-ischial shelf formed by step face 29 and upper surface 21 with the flesh immediately ahead of the ischial tuberosities 25 preferably pressed against the step face 29. In an effort to properly fit the growing child with the back of his or her knees against the front surface 11 of the base seating member 7, the back 37 of the wheelchair in FIG. 8 is commonly moved rearwardly from its substantially vertical position of FIG. 7. Alternately, the base seating member 7 is simply moved forwardly in the wheelchair. However, in either case, the end result particularly with children is that the child thrusts or scoots forward (see FIG. 9) until the flesh immediately ahead of his or hers ischial tuberosities 25 presses against the step face 29. This thrusting misaligns not only the child's knees and legs but also his or her back and places undue pressure on the ischial tuberosities. If neither the seat nor back is adjusted, the growing child will end up with his or her ischial tuberosities 25 very undesirably riding up and even over the step face 29. Unless corrected, these situations can lead to serious and undesirable problems.

Figure 9:
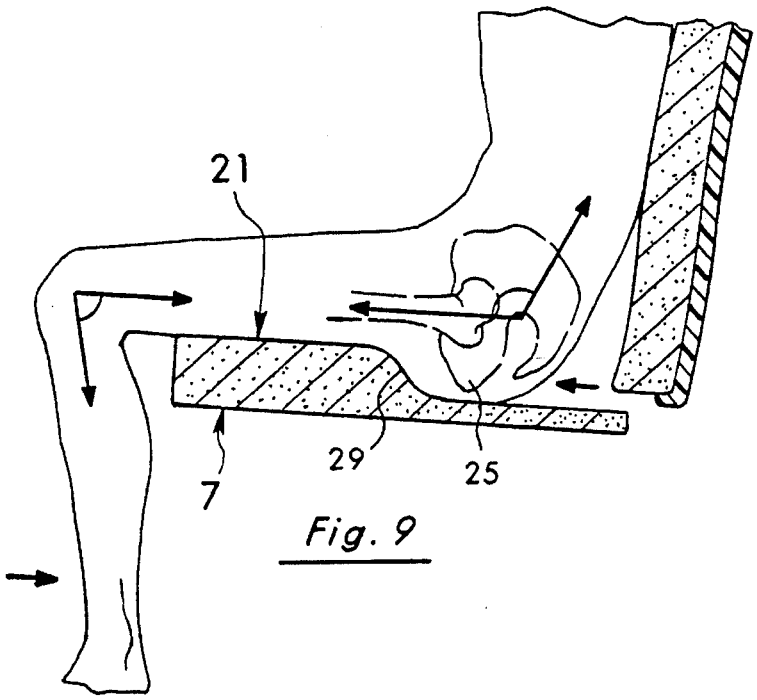
FIG. 9 illustrates the tendency of a person improperly fitted as in FIG. 8 to thrust or scoot forward into an undesirable position.

To compensate for the growth problems of FIGS. 7–9 (or if the user is a fully grown adult, to compensate for the simple misfitting of FIGS. 8 and 9), a separate step member 41 is provided as shown in FIGS. 10–13. The separate step means or member 41 as illustrated has a second step face 29'. In use, the separate step member 41 can be removably positioned (e.g., by hook and loop fasteners 43) immediately adjacent and rearwardly of the first step face 29. In doing so, it effectively serves to extend the first step face 29 rearwardly to the position of step face 29' in FIG. 13. In this manner, the first anti-thrust barrier formed by the first step face 29 is also effectively moved rearwardly to form a second anti-thrust barrier. As a result, the user of FIGS. 8 and 9 can then be properly fitted and supported in the desired position of FIG. 13.

The separate step member or means 41 is preferably dimensioned to conform to the step face 29 and to extend laterally across the central axis 19 of the base seating member 7 for a distance at least equal to the distance between the user's ischial tuberosities 25 (e.g., about 3 to 8 inches). The second step face 29' then slopes downwardly and rearwardly at about the same angle as the first step face 29 (e.g., about 45 degrees). Additionally, the separate step member 41 has an upper surface 21' (see FIG. 13) substantially aligning in use with the upper surface 21 of the forward section 15. In this manner, the surface 21' serves to effectively extend rearwardly the thigh supporting surface or shelf 21. The separate step member 41 and in particular, its upper surface 21' thus serves to form a pre-ischial shelf extender to better fit the user. Similarly, the conforming separate step member 41 serves to effectively extend rearwardly the original upper edge 27 to the new position of 27' in FIG. 13. It also effectively extends rearwardly the lower edge 33 to the new position of 33' in FIG. 13. In all such cases, the user's ischial tuberosities 25 are preferably positioned immediately adjacent and rearward of the lower edge 33 so as to be close to but not in front of the lower edge 33 (in the configuration of FIG. 7) and of the lower edge 33' (in the configuration of FIG. 13). In this manner, the ischial tuberosities 25 preferably are near or immediately adjacent the step face or anti-thrust barrier 29 in FIG. 7 and the second face step or anti-thrust barrier 29' in FIG. 13 for proper fits with the flesh immediately ahead of the ischial tuberosities 25 preferably pressed against the respective step face 29 or 29'.

As discussed above, the base seating member 7 and the pre-ischial shelf extender or separate step member 41 can be used with or without an overlying fluid pad 9. However, if a fluid pad 9 is used as shown in FIGS. 14–17, the fluid pad 9 is preferably designed so that the central pouches 45 (see FIG. 15) are always positioned over the base seating member 7 with the front seams 47 of the pouches 45 (see FIG. 14) forward of the edge 27. Additionally, the pouches 45 are preferably dimensioned so that their rear seams 49 are rearward of the lower edge 33 as well as rearward of the user's ischial tuberosities 25. Seams in this area and in particular, in the area of the ischial tuberosities 25 are to be avoided to prevent pressure and positioning problems (e.g., an ischial tuberosity loaded on a pouch near a seam will inevitably tend to migrate to the seam). This forward and rearward seam positioning is preferred regardless of whether the separate step member 41 is used (compare FIGS. 14 and 16) or even if a second separate step member 41' is used (see FIG. 17). This is also true whether or not the extra or separate base seating member 7' of FIGS. 18 and 19 is used. That is, when the child grows from the size of FIG. 7 to that of FIG. 8 (or when a fully grown adult is being fitted), it may be necessary to extend the thigh and fluid pad supporting surface or shelf 21 upwardly and rearwardly to the position of 21" in FIG. 19. Preferably, this is accomplished by fashioning the cushion 7' of FIG. 18 in the general shape of the upper support surface or shelf 21 and the extended shelf surface 21'. The extra cushion 7' can then be placed over both the surfaces 21 and 21' as shown in FIG. 19. This effectively raises the edge 27' in FIG. 16 to the position of edge 27'" in FIG. 19. It also shifts more weight load to the thigh supporting surface 21" particularly if the footrests are left in place. That is, with the addition of the extra cushion 7', the legs will leverage the ischial tuberosities 25 and coccyx up higher in the seating well 23 and will reduce the pressure on these bony prominences. For the same reason, the extra cushion 7' is desirable for use with children and adults with pelvic obliquities (i.e., one hip is lower than the other).

In this regard, the separate cushion 7' can be used with the base seating member 7 without the preischial shelf extender 41. In this embodiment, the size and shape of the separate cushion 7' are substantially the same as the upper surface 21 of the forward section 15. Also, in this embodiment, the base seating member 7 and separate base member 7' may be used with or without a fluid pad 9. Removable accessories which are normally used on the upper surface of the seating member, such as abductors or adductors, can be placed on top of the separate base member 7' to further position the legs. The separate base seating member 7' may also be used when a pelvic obliquity accessory is used in the bottom of the seating well 23. In this case, the pelvic obliquity build-up is used in one side of the seating well 23 to compensate for a tilted pelvis. However, this lifts the whole pelvis somewhat higher than it would be without this accessory. To compensate for the increased height of the seating well surface, the separate base member 7' can be used to raise the thighs correspondingly.

With the modified step member 41" of FIGS. 20–22, the front seams 47 of the pouches 45 are also positioned forwardly of the edges 27 and 28. The modified step member 41" as shown includes a raised bump portion with a convex upper surface 21'". Because this step member 41" is a separate, removable member, it can be positioned as desired alone or with other step members 41 and 41' (see FIGS. 20–22) to selectively position its bump portion 21'" relative to the user. The bump portion 21'" extends laterally across the base seating member 7 and serves essentially as a fulcrum. In this manner, the weight of the user's legs actually leverages the person's weight off the ischial tuberosities 25 to effectively reduce the ischial pressure. With some users, this bump portion or fulcrum 21'" is best positioned rearwardly (see FIGS. 20 and 22). With other users, it may be best positioned in the sandwiched arrangement of FIG. 21 in between the substantially horizontally aligned, upper surfaces 21 and 21' of members 7 and 41'. In this manner, the raised bump portion 21'" can be custom fit to the user's needs. The forward edge 28 of the modified step member 41" in the arrangements of FIGS. 21 and 22 is actually forward of the upper edge 27 of the base seating member 7. In the arrangement of FIG. 22, the lower edge 33" is then rearward of the lower edge 33 of the base seating cushion 7.

The arrangements of FIGS. 14–22 as discussed above can be used with or without the overlying fluid pad 9. However, if the fluid pad 9 is used, its front seams 47 of central pouches 45 are still preferably positioned as shown (i.e., forward of the extended upper edges 27', 27", and 27'" as well as forward of the original edge 27 and edge 28 of member 41"). Similarly, the pouches 45 are preferably dimensioned so that their rear seams 49 are always positioned rearwardly of the user's ischial tuberosities 25. In this manner, no lateral seams such as 47 or 49 are positioned over the step face 29 in the configuration of FIG. 14 or over the second or third step faces 29' or 29" in the configurations of FIGS. 16 and 17 or over step face 29'" in the configuration of FIG. 20.

The fluid pad 9 preferably has additional pouches 45' both forward and rearward of the central or step pouches 45. However, the fluid pad 9 with such additional pouches 45' is still preferably dimensioned to position the front seams 47 of the central pouches 45 immediately adjacent and forward of the edge 27 in the respective configurations of FIGS. 14, 16, 17, and 19. Additionally, the front seams 47 are preferably positioned substantially closer to the upper edge 27 than to the front surface 11 of the base seating member 7. These laterally extending seams 47 aid in keeping or trapping fluid in the forward pouches 45' in front of the seams 47 for proper support of the thighs. Similarly, the rear seams 49 of the central or step pouches 45 are positioned at least in the configurations of FIGS. 16, 17, and 19 closer to the respective lower edges 33' and 33" than to the rear surface 15 of the base seating member 7. Preferably, a longitudinal, central seam such as 51 in FIG. 15 can also be provided for additional side-to-side stability. The purpose of this seam 51 is to prevent the fluid from migrating to one side and causing a pelvic obliquity (i.e., one hip lower than the other) with a resulting scoliosis of the spine. In this regard, its alignment with the central axis 19 of the base seating member 7 will place the seam 51 between the halves of the user's buttocks where bottoming out is not usually a problem. The fluid in the fluid pad 9 is preferably a high viscosity liquid but can be a gas, water, or other fluid if desired.

Back System

The adjustable back system 2 of the present invention has been specially designed to provide a low profile with minimum seat depth loss in its retracted position and to offer substantial forward adjustments about multiple axes in its extended positions.

Figure 23:
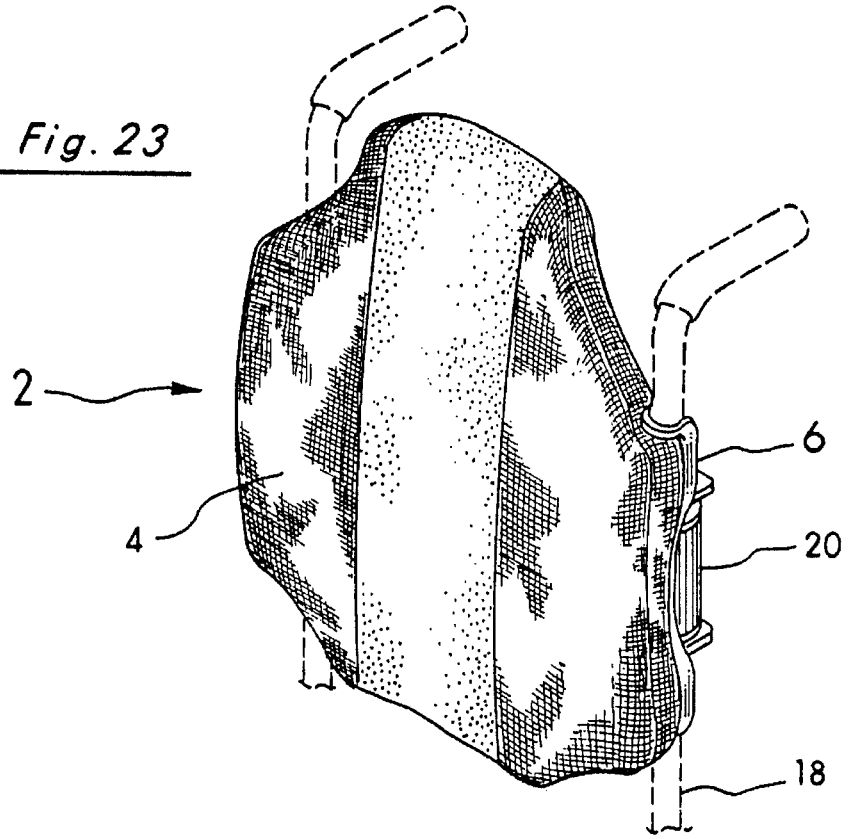
FIG. 23 is a perspective view of the adjustable, low profile back system of the present invention positioned on the back posts of the wheelchair.
Figure 24:
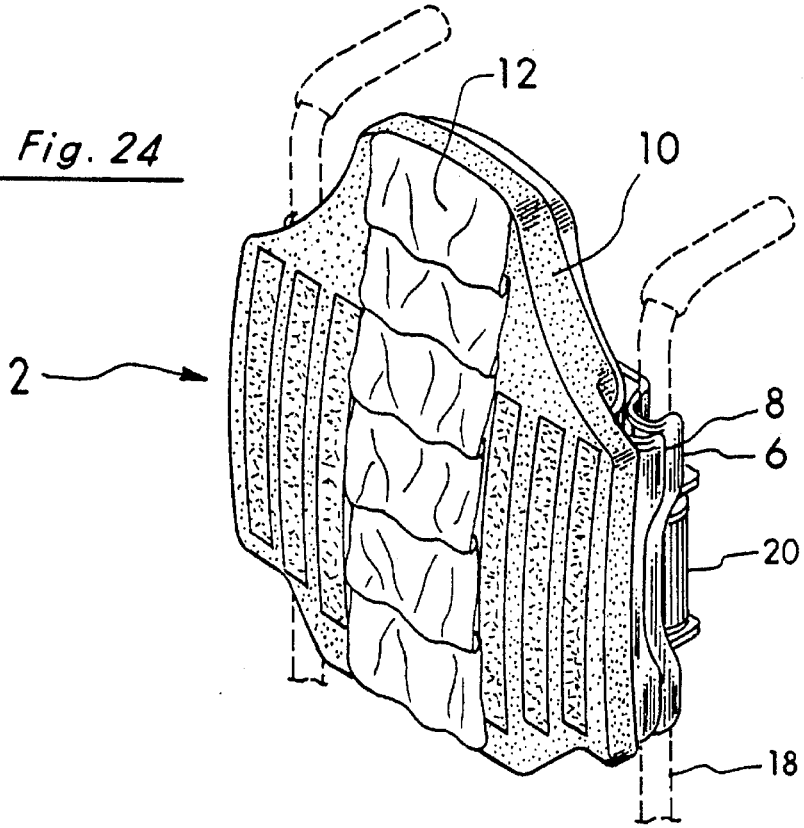
FIG. 24 is a view of the adjustable back system of FIG. 23 with the cover removed and showing the back system in its forward or extended position.

The back system 2 (see FIG. 23) includes an outer cover 4 as well as a mating pair of relatively rigid shell members 6 and 8 (see FIGS. 24 and 25) and back cushion 10 shown with a fluid spinal pad 12. In use as shown in FIG. 23, the cover 4 extends over the pad 12 and cushion 10 and can additionally extend over portions of the forward shell member 8. To attach the back system 2 to the wheelchair 3, brackets 14 (see FIG. 26) are first secured by screws 16 to the upright back posts.18 of the wheelchair 3 at the desired height. The wing laches 20 (see FIG. 25) of the rearward shell member 6 are then swung about the back posts 18 within the brackets 14 (see FIG. 26) and removably secured in place by twist locks 22.

Figure 25:
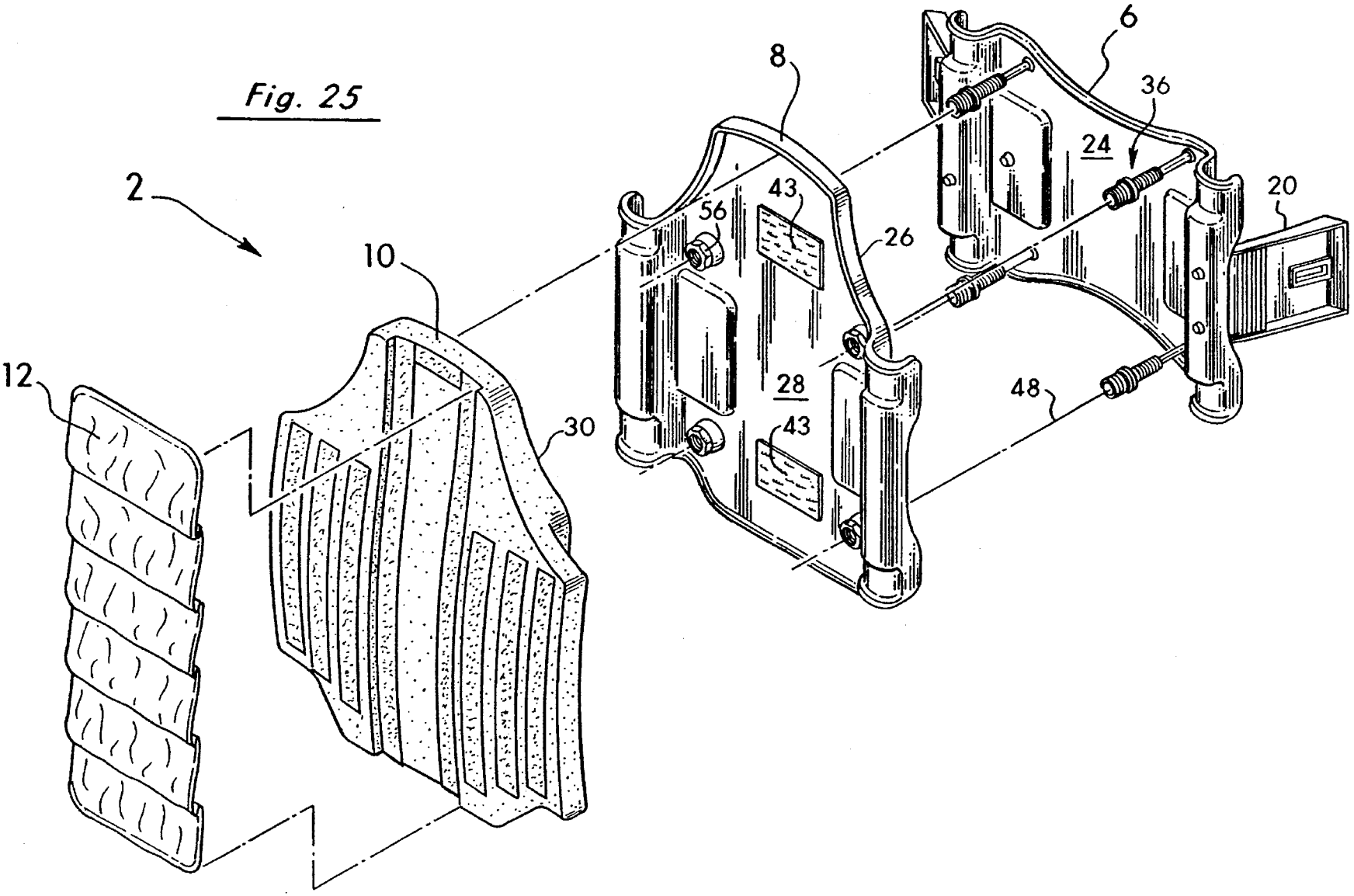
FIG. 25 is an exploded view of the back system of FIG. 24.
Figure 26:
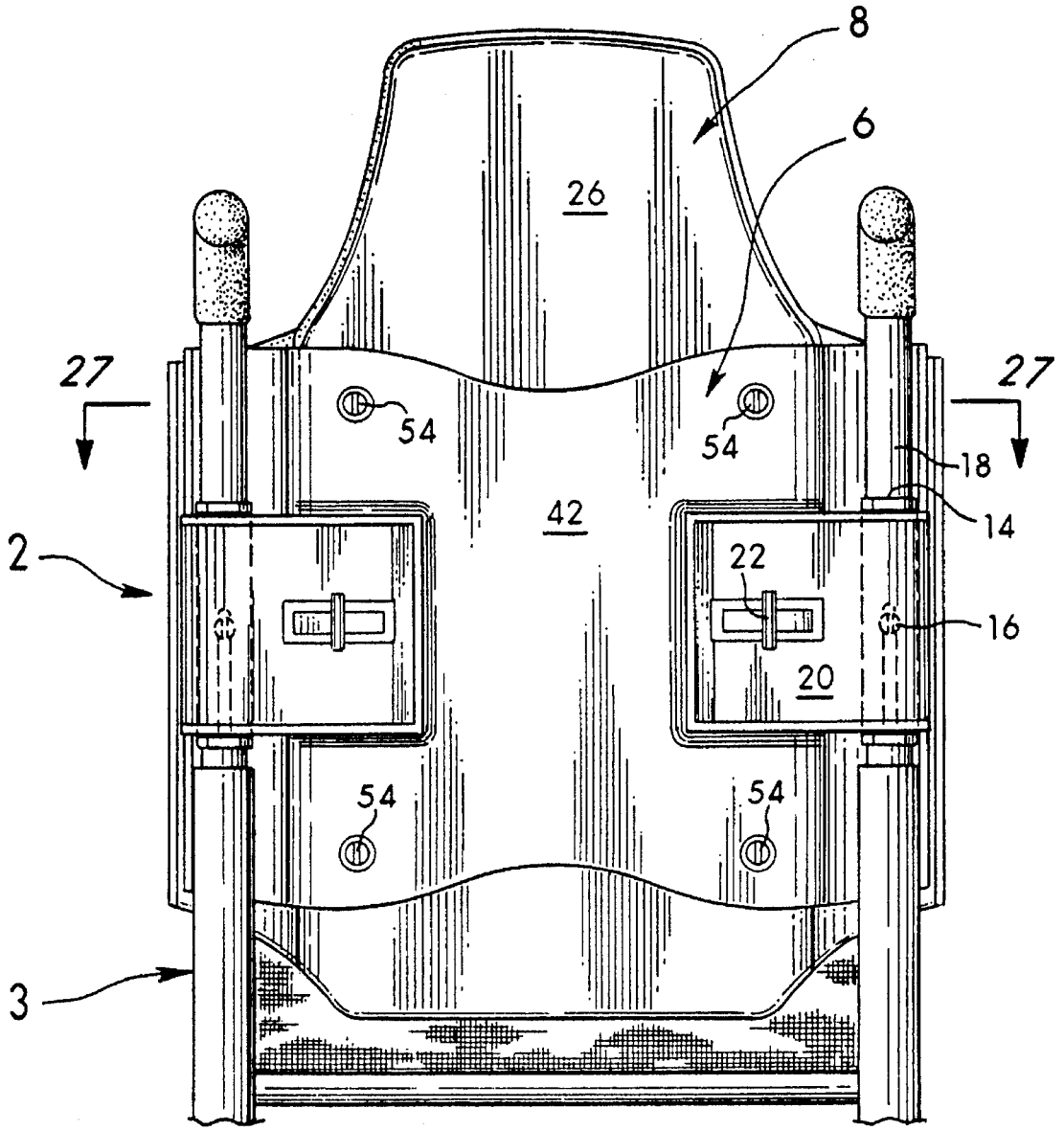
FIG. 26 is a rear view of the back system taken along line 26—26 of FIG. 1.

The first and second shell members 6 and 8 as shown in FIGS. 25 and 27–28 are designed so that the contours of the front surface 24 of the shell member 6 and the back surface 26 of the shell member 8 substantially match and mate or nest with one another in the retracted position of FIG. 27. Similarly, the cushion 10 is attached to the shell member 8 (e.g., preferably by hook and loop fasteners 43) wherein the back surface 30 of the foam cushion 10 is preferably shaped to match and substantially mate or nest against the front-surface 28 of the shell member 8. In operation and with the shell members 6 and 8 in their retracted position of FIG. 27, all of the surfaces 24, 26, 28, and 30 are preferably nested as shown in FIG. 27 and extending substantially between and along the back posts 18. This gives the back 2 a very low profile visa vis the back posts 18 as very little of the back 2 extends forwardly of the back posts 18 in the retracted position of FIG. 27. Aiding in the ability of the back 2 to have very little of it extend forward of the front plane P (see FIG. 27) that extends across the front of the back posts 18 is the nesting of central portions 42, 42', and 42" of members 6, 8, and 10. That is, as shown in FIG. 27, these nesting, central portions 42, 42', and 42" extend between and along posts 18 in the retracted position substantially behind or rearward of plane P. They also extend substantially between planes P and P' of the front and back of posts 18 to substantially fall within the depth profile of the back posts 18.

Additionally, to further aid in reducing the seat depth loss in the retracted position, the foam cushion 10 is molded or cut to include depressions 32 (see FIGS. 27 and 28). These depressions 32 in the back surface 30 of the cushion 10 as shown in FIG. 27 are dimensioned to receive the forward end portions 34 of the screw arrangements 36 when the screw arrangements 36 are in their fully retracted positions. In these positions, the forward end portions 34 of the screw arrangements 36 pass through and project forwardly of the front surface 28 of the shell member 8 and into the depressions 32 in the cushion 10. More specifically, the first rigid shell member 6 as shown in FIGS. 27 and 28 is mounted with its C-shaped, wing portions 40 about the back posts 18 and its first or central portion 42 extending substantially between and along the back posts 18. The second shell member 8 is then mounted by screw arrangements 36 to the first or central portion 42 of the shell member 6. In operation as explained in more detail below, the screw arrangements 36 can then be selectively operated to move the second shell member 8 relative to the first shell member 6 and back posts 18 about multiple axes.

Each screw arrangement 36 as best seen in FIGS. 29 and 30 includes first and second telescoping screw members 44 and 46. These screw members 44 and 46 are mounted to be selectively moved relative to each other along the axis 48. The rearward end portion 50 of each screw arrangement 36 is spherical and mounted within a spherical bearing 52 to the rear shell member 6. In operation, the screw head 54 can be turned as desired to selectively extend and retract the telescoping screw members 44 and 46. In doing so, the forward or second end portion 34 of the screw arrangement 36 moves within and relative to the nut 56 which is fixed relative to the forward shell member 8. The nut 56 in turn helps maintain the screw members 44 and 46 aligned horizontally.

By selectively operating each of the four screw arrangements 36 by turning the screw heads 54 (see FIG. 26), the forward shell member 8 and cushion 10 can be moved from the retracted position of FIGS. 27 and 31 with the shell surfaces 24 and 26 substantially adjacent or abutting each other to any number of extended positions including those of FIGS. 32–35. In FIG. 32, each of the screw arrangements 36 has been extended its maximum distance (e.g., 2 to 3 or more inches). In doing so, the back surface 26 of the shell member 8 is maintained essentially in the same substantially vertical position as in its retracted position of FIG. 31. It is also moved essentially along a substantially horizontal axis 48' which is substantially parallel to the axes 48 of the screw arrangements 36 and substantially perpendicular to the surface 24 of the rear shell member 6. By selectively extending only the top two screw arrangements 36 in FIG. 33, the back surface 26 of shell member 8 can be inclined forwardly. Such inclination relative to, for example, a vertical plane extending through the upright, vertical back posts 18 of the wheelchair could be at 20 or so degrees. This inclination would be essentially about a horizontal axis through such a reference vertical plane. Similarly, by extending only the bottom two screw arrangements 36 in FIG. 34, the back surface 26 can be inclined rearwardly (e.g., 20 or so degrees about a horizonal axis in the reference vertical plane). Likewise, by extending the screw arrangements 36 in differing amounts as shown in the top plan view of FIG. 35, the back surface 26 can be inclined laterally about a vertical axis substantially in the reference vertical plane.

In this manner, the selective extension of the four screw arrangements 36 in varying amounts enables the back cushion 10 to be positioned in a wide range of positions as a result of manipulating the back surface 26 of the shell member 8 about the above-mentioned multiple axes. Such manipulation can be done simultaneously or sequentially to properly fit and support the user on the seat 1 against the back 2. In doing so, the relatively rigid shell member 8 can be made of a material (e.g., plastic) that has some give or flex to it to further enable the shell member 8 to be positioned as desired by manipulation of the screw arrangements 36. As disclosed in FIG. 26, the back system 2 preferably uses four screw arrangements 36 located essentially at the corners of a quadrilateral figure (e.g., rectangle); however, a fewer or greater number of screw arrangements 36 could be used as desired. Additionally, the back system 2 can be removed from the wheelchair 3 by simply twisting the locks 22 to free the wing portions 20. Once so removed, the screw arrangements 36 maintain the front shell member 8 and cushion 10 in whatever position they were relative to the rear shell member 6. That is, the attaching means at 20 and the shell moving means at 36 operate independently of each other. Consequently, when desired, the rear shell member 6 can then be re-attached by wing portions 20 and twist locks 22 to the upright back posts 18 wherein the front shell member 8 and cushion 10 will be automatically returned to their previously set, desired position relative to the seat 1 and back posts 18.

While several embodiments of the invention have been shown on described in detail, it is to be understood that there is modifications and changes to be made to them without departing from the scope of the invention.

We claim:

1. An adjustable back system primarily intended for use with a wheelchair having two upright back posts, said system including:

a relatively rigid first shell member, a relatively rigid second shell member having a front surface, an attaching assembly formed for attaching said first shell member to the back posts of said wheelchair, said first shell member having a first portion dimensioned to extend substantially between and along said back posts when mounted to said back posts, said attaching assembly being further formed for attaching said first shell member to said back posts in a first position fixed relative to said back posts, and a mounting assembly mounting said second shell member to the first portion of said first shell member, said mounting assembly being further formed for moving said second shell member relative to said first shell member from a retracted position adjacent said first shell member to an extended position spaced from said first shell member, said first shell member having a front surface and said second shell member having a back surface, said moving means moving said front and back surfaces into a substantially abutting relationship in said retracted position, and said front and back surfaces each being concaved intermediate said posts and formed with vertically extending side channels dimensioned to receive said posts, said front and back surfaces further having mating contours wherein said front and back surfaces nest with each other in said retracted position.

2. The adjustable back system of claim 1 wherein, said back system further includes a back cushion member having a back surface and an assembly attaching said cushion member to said second shell member with said back surface of said cushion member substantially adjacent said front surface of said second shell member, said back surface of said back cushion member being dimensioned to extend substantially between and along said back posts when said back system is mounted to said back posts and said first and second shell members are in said retracted position.

3. The adjustable back system of claim 2 wherein, said back cushion member has a rear portion immediately forward of said back surface of said back cushion member, said rear portion of said back cushion member being positioned substantially between and along said back posts substantially rearwardly of a transversely extending plane between front sides of said back posts when said back system is mounted to said back posts and said first and second shell members are in said retracted position.

4. An adjustable back system primarily for use with a wheelchair comprising:

a relatively rigid first shell member, a relatively rigid second shell member, an attaching assembly formed for attaching said first shell member to a frame of said wheelchair in a fixed position to support a user's back, a mounting assembly movably mounting said second shell member to said first shell member for movement between a retracted position adjacent said first shell member and an extended position spaced from said first shell member, said mounting assembly including a mounting member projecting forwardly from said first shell member toward said second shell member, said second shell member and said mounting assembly being formed with a recess dimensioned to receive said mounting member when said second shell member is in said retracted position to minimize the depth dimension of said back system, and a back cushion mounted to a forwardly facing side of said second shell member and formed to define with said second shell member and said mounting assembly said recess receiving said mounting member.

5. The adjustable back system of claim 4 wherein, said mounting member extends along an axis and has a first end portion and a second end portion spaced from each other along said axis, and said first end portion being mounted to said first shell member with said second end portion projecting forwardly of said second shell member and into said recess in said cushion member when said second shell member is in said retracted position.

6. The adjustable back system of claim 5 wherein, said mounting assembly has at least two mounting members, said two mounting members being mounted to each other for movement relative to each other along said axis.

7. The adjustable back system of claim 6 wherein, said two mounting members are mounted for telescoping movement relative to each other.

8. The adjustable back system of claim 6 wherein, said two mounting members are formed with mating threaded portions for movement relative to each other upon rotation of at least one of said two mounting members.

9. The adjustable back system of claim 8 wherein, said mounting member mounted to said first shell member is for rotation about said axis to effect movement of said two mounting members relative to each other.

10. The adjustable back system as defined in claim 9 wherein, said mounting member mounted to said first shell member is further formed for articulation relative to said first shell member.

11. The adjustable back system as defined in claim 9 wherein, said two mounting members are screw members threaded together in telescoped relation.

12. An adjustable back system primarily for use with a wheelchair comprising:

a relatively rigid first shell member, a relatively rigid second shell member, an attaching assembly formed for attaching said first shell member to a frame of said wheelchair in a fixed position to support a user's back, and a mounting assembly movably mounting said second shell member to said first shell member for movement between a retracted position adjacent said first shell member and an extended position spaced from said first shell member, said mounting assembly including a mounting member projecting forwardly from said first shell member toward said second shell member, said second shell member and said mounting assembly being formed with a recess dimensioned to receive said mounting member when said second shell member is in said retracted position to minimize the depth dimension of said back system, said mounting assembly includes at least three moving arrangements, each moving arrangement being spaced from each other and extending between said first shell member and the second shell member, and each of said moving arrangements further including at least one mounting member extending along an axis and having a first end portion and a second end portion spaced from each other along said axis, said mounting member being mounted with said first end portion coupled to said first shell member and with said second end portion projecting forwardly of said second shell member when said second shell member is in said retracted position.

13. The adjustable back system of claim 12 wherein, each said moving arrangement has a first mounting member and a second mounting member mounted to said first mounting member for relative movement along said axis.

14. The adjustable back system of claim 13 wherein, said first mounting member and said second mounting member telescope with each other.

15. The adjustable back system of claim 12 further including at least a fourth moving arrangement spaced from the other three moving arrangements and extending between said first shell member and the second shell member.

* * * * *